US009717358B2

(12) United States Patent
Davis

(10) Patent No.: US 9,717,358 B2
(45) Date of Patent: Aug. 1, 2017

(54) BELT AND NECKTIE RACK

(71) Applicant: Kevin R. Davis, Beverly Hills, CA (US)

(72) Inventor: Kevin R. Davis, Beverly Hills, CA (US)

( * ) Notice: Subject to any disclaimer, the term of this patent is extended or adjusted under 35 U.S.C. 154(b) by 15 days.

(21) Appl. No.: 14/530,274

(22) Filed: Oct. 31, 2014

(65) Prior Publication Data

US 2016/0120351 A1 May 5, 2016

(51) Int. Cl.
*A47G 25/74* (2006.01)

(52) U.S. Cl.
CPC ..... *A47G 25/746* (2013.01)

(58) Field of Classification Search
CPC ..... A47G 25/743; A47G 25/0685; A47G 25/746; A47G 25/0664; A47G 25/06; A47G 25/50; A47G 25/14; A47G 25/1457; A47G 25/30; A47G 25/32; A47G 25/487; A47G 25/74; A47G 25/28; A47G 25/18; A47F 7/12; A47F 7/19; A47F 3/08; A47F 7/06; A47F 7/065; A47F 5/0876; A47B 61/003; A47B 61/00; A47B 61/02; Y10S 223/01; Y10S 223/04
USPC ..... 211/96, 85.3, 163, 168, 113, 87.01, 116, 211/165, 89.01, 106.01, 119, 85.2, 106, 211/104, 193, 100, 105.1, 181.1; 223/85, 223/DIG. 1, DIG. 4, 88; 248/215, 218.1, 248/302
See application file for complete search history.

(56) References Cited

U.S. PATENT DOCUMENTS 1,248,843 A * 12/1917 Gay ..... A22B 5/06 211/89.01
2,098,715 A * 11/1937 Awbrey ..... A47G 25/06 211/120
2,499,159 A * 2/1950 Pestyner ..... A47G 25/746 211/104
2,515,293 A * 7/1950 Carter ..... A47F 5/0876 211/104
2,527,713 A * 10/1950 Dunn ..... A01G 17/08 119/322
2,582,127 A * 1/1952 Hort ..... A47G 25/746 211/104

(Continued)

FOREIGN PATENT DOCUMENTS

FR 1510059 11/1966

*Primary Examiner* — Daniel J Troy
*Assistant Examiner* — Hiwot Tefera
(74) *Attorney, Agent, or Firm* — Blakely Sokoloff Taylor & Zafman LLP

(57) ABSTRACT

A combined belt and necktie rack described herein hangs belts via pegs through holes in their leather straps rather than by the buckles. If the pegs are made from small-diameter, rigid materials the belts can effortlessly be slid onto the pegs through a hole in the strap. The pegs easily support the belts' weight, and if the pegs are long enough, they will accommodate neckties being draped over the pegs as well. The end of each peg may be bent horizontally at a right angle to the rest of the peg, for the belt to be hung. In this fashion, belts and neckties are parallel to each other and lay flat against each other, rather than a space-consuming perpendicular arrangement. The pegs may be coupled to a frame piece which may thereafter use mounting blocks to either statically or dynamically couple the frame piece and corresponding pegs to a structure.

25 Claims, 7 Drawing Sheets

(56) References Cited

U.S. PATENT DOCUMENTS 2,666,530 A * 1/1954 Beren ..... A47G 25/746 211/104
2,831,581 A * 4/1958 Kruger ..... A47G 25/746 211/104
2,957,671 A * 10/1960 Messier ..... A47F 5/0823 248/220.43
3,245,645 A * 4/1966 Dupler ..... A47G 25/0678 248/215
3,939,985 A * 2/1976 Hochman ..... A47F 5/0823 248/220.22
4,103,778 A * 8/1978 Bradshaw ..... A47F 7/19 211/102
4,243,146 A * 1/1981 Davitz ..... B05C 13/00 118/500
4,569,450 A * 2/1986 Dillingham ..... A47G 25/746 211/104
4,611,721 A * 9/1986 Heckaman ..... A47G 25/746 211/100
4,616,753 A * 10/1986 Aslan ..... A47F 5/0807 211/57.1
4,834,248 A * 5/1989 Lee ..... A47G 25/74 211/113
5,209,382 A * 5/1993 Chang ..... A47G 25/746 211/87.01
5,425,463 A * 6/1995 Toscanini ..... A47G 25/746 211/104
5,642,841 A 7/1997 Beaty
6,021,907 A * 2/2000 O'Brien ..... A47B 61/003 211/89.01
8,028,844 B2 * 10/2011 Costa ..... A47B 61/02 211/104
8,596,588 B1 * 12/2013 Sikkema ..... H02G 3/30 211/70.6
8,752,814 B1 * 6/2014 Oliveto ..... B25B 11/00 211/85.2
8,915,384 B2 * 12/2014 Immerman ..... A47K 10/04 211/119
2006/0284040 A1 * 12/2006 Nixon ..... B62J 11/00 248/311.2
2015/0167356 A1 * 6/2015 Leyden ..... E05B 73/0017 223/85

* cited by examiner

BELT AND NECKTIE RACK

FIELD

A combined belt and necktie rack, which provides an efficient structure for hanging and storing both belts and neckties simultaneously, is disclosed.

BACKGROUND

Many individuals possess numerous neckties and belts. This large quantity of neckties and belts may offer the individual a variety of styles and choices for different occasions and settings. An issue that often arises when possessing a large number of neckties and belts is related to storage and organization. In particular, for various reasons, belts and neckties are not suitable for being folded, rolled, or otherwise compacted for storage in a drawer. Further, storage in a drawer may not allow an individual to quickly and easily view each belt and necktie when deciding which combination will be worn.

To address this issue regarding the difficulty of storing belts and neckties in drawers, many individuals choose to hang their belts and neckties. For example, some individuals may choose to hang belts and/or neckties on clothes hangers or on pegs on the back of a closet door. Although hanging belts and neckties in this fashion may somewhat reduce the likelihood that these items will be damaged during storage, this practice is inefficient. In particular, only a small number of belts and neckties may be stored on each hanger and on each general purpose peg. Further, since these structures are not intended to hold belts and neckties, belts and neckties may be precariously held on these devices and may be prone to fall/slide off.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

SUMMARY

Most men need a belt rack and men who wear suits and neckties need a necktie rack. With the appropriate design, the two functions may be combined in the same rack. In building a necktie rack, the pegs of the rack may be positioned closely together (e.g., ½-inch apart) because the neckties are hung flat against each other. In building a belt rack in which the belts are hung on the pegs by their buckles, however, the belts are not hung flat against each other but are turned perpendicular from the neckties and hung width-by-width. Thus, the pegs must be positioned at least 1½-inches apart to accommodate the widths of belt buckles. So it is problematic to construct a combination belt-and-necktie rack that is efficient at hanging both belts and neckties, so long as the belts are hung by their buckles. Furthermore, this peg-through-buckle system will never accommodate all belts, in any case, because approximately 15% or more of belts on the market have a solid metal-plate buckle (i.e., no hole in the buckle).

To overcome the above problems, the combined belt and necktie rack described herein hangs belts via pegs through the normal holes in their leather strap rather than by the buckles. If the pegs are made from small-diameter, rigid stainless steel, the belts can effortlessly be slid onto the pegs through one of the holes in the strap. The steel easily supports the belts' weight, and if the pegs are long enough, they will accommodate neckties being draped over the pegs as well. In some embodiments, the end of each peg (e.g., the last ⅜-inch of the peg) may be bent horizontally at a right angle to the rest of the peg, for the belt to be hung. That way, the belts and the neckties are parallel to each other and lay flat against each other, rather than a space-consuming perpendicular arrangement.

It is contemplated that the frame piece, into which the pegs are mounted, be a light metal, such as aluminum. This results in a modern styling. However, if a more traditional appearance is desired, the frame piece may be made out of oak or some other hardwood. It is further contemplated that the steel pegs may project from both sides of the frame piece, thereby doubling the capacity of the rack. In this case, the rack would be mounted to the wall at one end of the frame piece with a swivel/pivot hinge bracket, allowing the rack to lay flat against the wall when not in use, but be swung out to access both sides during selection of a necktie or a belt. A one-sided version of the rack may also be made where the rack is mounted stationary against the wall with screws. In yet another embodiment, the rack may be installed on a track mounted inside a cabinet or closet, which allows the rack to slide in for storage but out for selection of a belt and/or a necktie.

In one embodiment, the pegs extend 1¼-inches from the frame piece to accommodate necktie widths and are spaced 1¼-inches apart to accommodate male fingers accessing a belt. In some embodiments, an upper and lower row of pegs may be installed 1-inch apart vertically with the pegs staggered in a saw-tooth pattern to double the capacity of the rack. Furthermore, the front section of the pegs (i.e., the last ⅜-inch section at the end of the pegs that is 90 degrees from the rest of the peg) may include a number of features, including 1) a slight upward slant or curve to prevent a belt hanging by its hole from accidentally sliding off; (2) a 90° corner between this front section and the rest of the peg may be sharp (i.e., not a gradual curve) to inhibit a hanging belt from sliding around the corner; and (3) the 90° corner may have a spherical knob to further prevent a hanging belt from sliding around the corner.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1A:
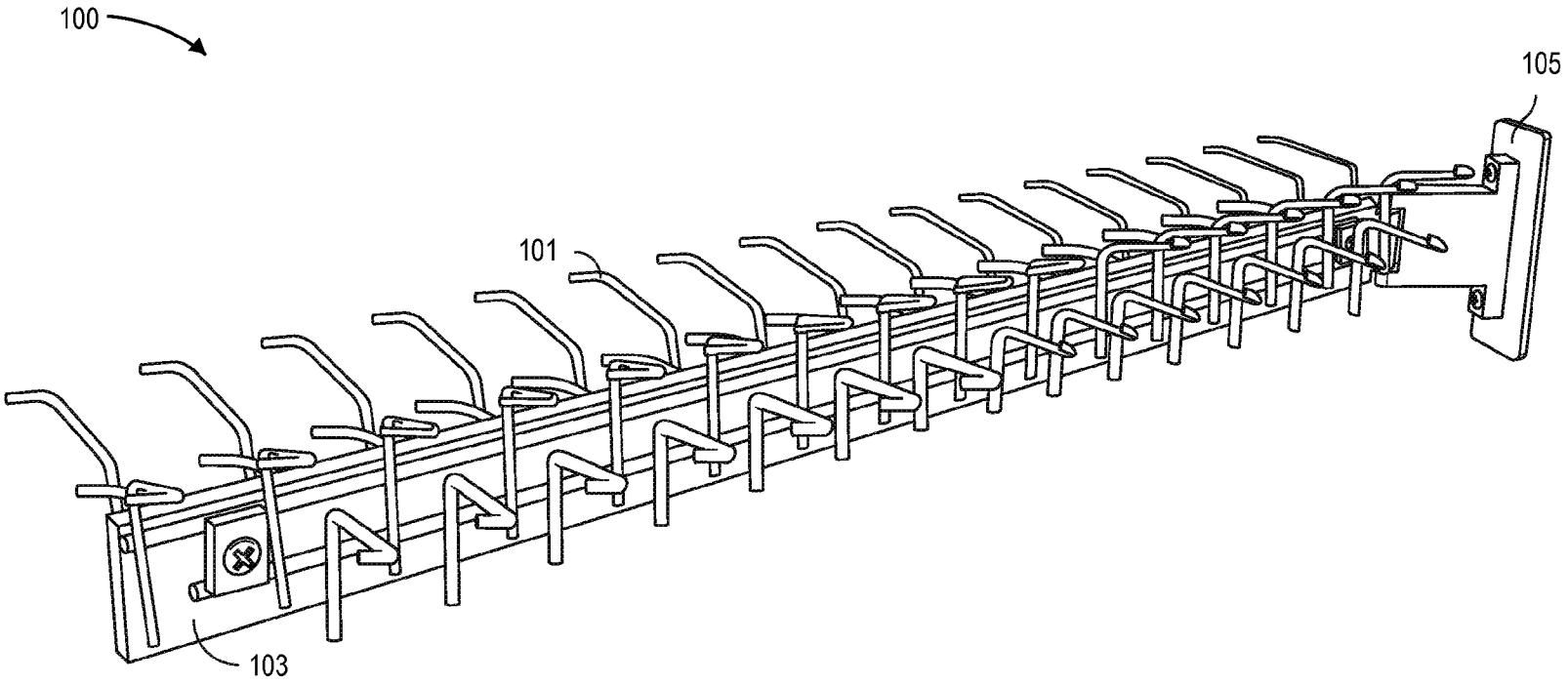
FIG. 1A shows a perspective view of a combined belt and necktie rack according to one embodiment.

FIG. 1A shows a combined belt and necktie rack 100 according to one embodiment. The combined belt and necktie rack 100 may include a set of pegs 101, a frame piece 103, and one or more mounting blocks 105. As will be described in greater detail below, the combined belt and necktie rack 100 allows for the efficient storage/hanging of a number of belts and neckties. In particular, the combined belt and necktie rack 100 allows for belts and neckties to be easily placed on the rack 100, viewed on the rack 100, and removed from the rack 100. Each of the elements of the combined belt and necktie rack 100 will be now described by way of example.

The frame piece 103 may be a rigid structure that is equipped to receive the set of pegs 101. In one embodiment, as shown in FIG. 1A, the frame piece 103 may be defined by a thin, elongated rectangular structure. Although shown as rectangular, in other embodiments the frame piece 103 may be formed in other shapes, including a cylinder or a prism.

The frame piece 103 may be formed of various materials, including plastic polymers (e.g., polystyrene and polyvinyl chloride), woods (e.g., oak, pine, mahogany, walnut, and teak), elemental metals (e.g., aluminum), metal alloys (e.g., steel), or some combination of these materials. In some embodiments, the frame piece 103 may be a solid structure (i.e., without hollow sections). This solid construction may be appropriate for lighter materials (e.g., woods) that provide a stable structure while still offering a manageable weight such that the rack 100 may be easily mounted. In other embodiments, the frame piece 103 may be at least partially hollow. For example, the frame piece 103 may be made of a hollow aluminum casing that provides a high specific strength (i.e., strength-to-weight ratio). The casing that defines this hollow, aluminum frame piece 103 may have a wall thickness between 1/16-1/8 inches. Accordingly, in this embodiment, the frame piece 103 may be made of denser materials, but may still maintain a manageable weight for mounting.

The frame piece 103 may be formed with various dimensions according to the requirements/needs of the user. For example, the frame piece 103 may be between 12.0-48.0 inches in length, between 2.0-3.0 inches in width, and between 0.5-3.0 inches in depth. The dimensions of the frame piece 103 may be based on 1) the number of pegs 101 desired by the user, which in turn may correspond to the number of belts and/or neckties owned by the user and/or 2) the space/structure in which the combined belt and necktie rack 100 will be installed. For example, the combined belt and necktie rack 100 may be installed in a closet having a width of 36.0 inches. In this situation, the frame piece 103 may be 36.0 inches in length. In other embodiments, the frame piece 103 may be slightly smaller than the provided installation space to accommodate for the one or more mounting blocks 105, which may be needed for installation, as will be described in greater detail below.

In one embodiment, the pegs 101 may be thin cylindrical structures that are coupled or otherwise attached along the length of the frame piece 103. Accordingly, in some embodiments, the pegs 101 may have a circular cross-sectional shape; however, in other embodiments, the pegs 101 may have a different cross-sectional shape (e.g., triangular or rectangular). The pegs 101 may be formed of various materials, including plastic polymers (e.g., polystyrene and polyvinyl chloride), woods (e.g., oak, pine, mahogany, walnut, and teak), elemental metals (e.g., aluminum), metal alloys (e.g., steel), or some combination of these materials. In some embodiments, the pegs 101 and the frame piece 103 are formed of different materials, while in other embodiments the pegs 101 and frame piece 103 are formed from the same material.

Figure 1B:
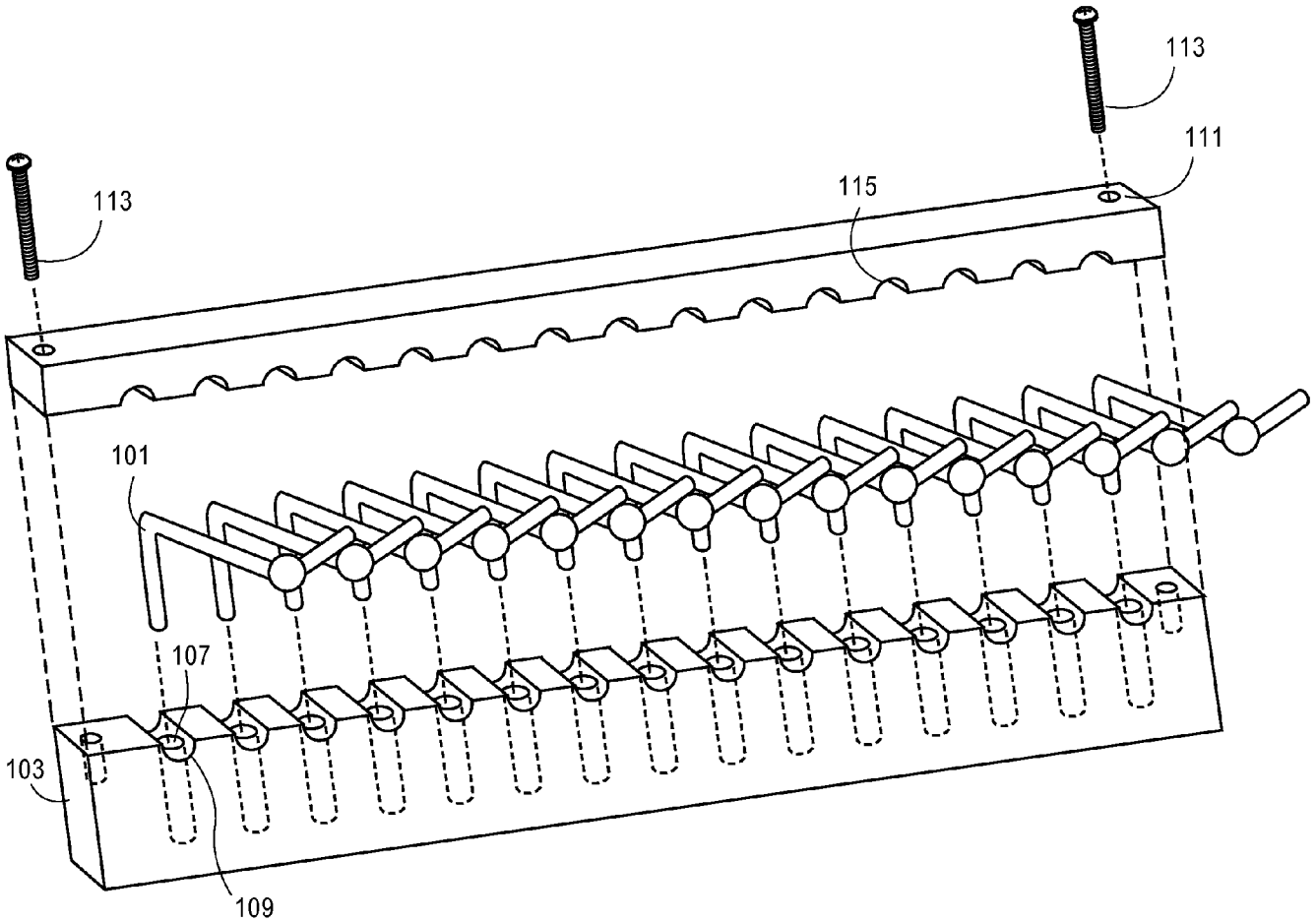
FIG. 1B shows an exploded view of a combined belt and necktie rack according to another embodiment.

In one embodiment in which both the pegs 101 and the frame piece 103 are formed from metals, the pegs 101 may be soldered or welded to the frame piece 103 as shown in FIG. 1A. In other embodiments, different types and/or mechanisms may be used for coupling the pegs 101 to the frame piece 103. For example, as shown in FIG. 1B, in one embodiment, vertical holes 107 may be drilled into the top of the frame piece 103. The vertical holes 107 may have a diameter slightly larger than the cross-sectional diameter of the pegs 101 such that a peg 101 may fit within each of the vertical holes 107 securely preventing the pegs 101 from rotating forward under the weight of a belt. In one embodiment, channels 109 may be included on the top side of the frame piece 103 and aligned with the vertical holes 107. The length of the channels 109 may extend across the width of the frame piece 103 and the width of the channels 109 may be sized to accommodate the cross-sectional diameter of the pegs 101. Accordingly, the pegs 101 may be inserted into the vertical holes 107 and through engagement with the channels 109 the pegs 101 are held static relative to frame piece 103.

In some embodiments, a locking bar 111 may secure the pegs 101 within the channels 109 and/or the vertical holes 107. The locking bar 111 may have a length and width equal to that of the top part of the frame piece 103 such that the locking bar 111 may cover the channels 109 and the vertical holes 107. In some embodiments, the locking bar 111 may form hemi-cylindrical grooves 115, which along with complimentary channels 109, securely hold the pegs 101. The grooves 115 may be equal in size to the channels 109 such that a combined set of groove 115 and channel 109 is shaped to completely fit around the circumference of the a cross-section of a peg 101. As shown in FIG. 1B, the locking bar 111 may be coupled to the frame piece 101 using screws 113. However, in other embodiments, any mechanism may be used for coupling the locking bar 111 to the frame piece 103.

Although FIG. 1A and FIG. 1B show two embodiments for coupling the pegs 101 to the frame piece 103, the pegs 101 may be coupled to the frame piece 103 using any mechanism. For example, the pegs 101 may be coupled to the frame piece 103 using screws, bolts, clips, clamps, or other removable fasteners. In these example embodiments or in the example shown in FIG. 1B, the pegs 101 may be adjustable by a user. For example, the pegs 101 may be moved, removed, and/or added to the frame piece 103 as desired by the user by coupling and decoupling the pegs 101 from the frame piece 103 using these removable fasteners.

Figure 2:
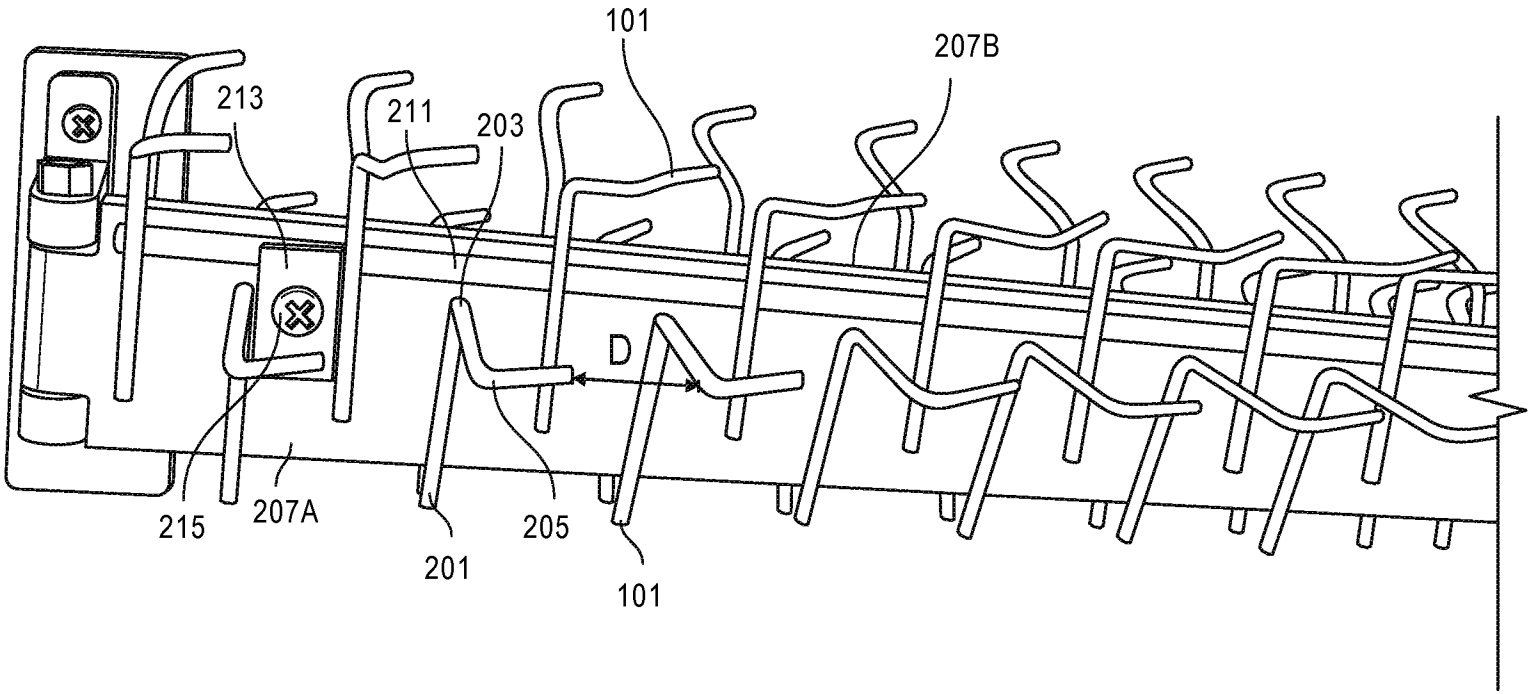
FIG. 2 shows a side view of a combined belt and necktie rack according to one embodiment.

In one embodiment, the pegs 101 may be coupled to frame piece 103 during manufacture. In this embodiment, the pegs 101 may be spaced to accommodate the width of a standard belt, the width of a standard necktie, and/or to allow the fingers of an average sized human user to easily grab/select a necktie or belt. For instance, as shown in FIG. 2, the pegs 101 may be separated by the distance D. In one embodiment, the distance D may be 1¼ inches. Using this separation distance D, the fingers of a user may easily grab a necktie or belt without interfering with other neckties and belts held by adjacent pegs 101. In other embodiments, the distance D between each peg 101 along the frame piece 103 may be between 0.75 inches and 1.5 inches. In these examples, the measurements for D are taken from the leftmost boundary of a first peg 101 to the right most boundary of an adjacent second peg 101 as shown in FIG. 2.

Figure 3:
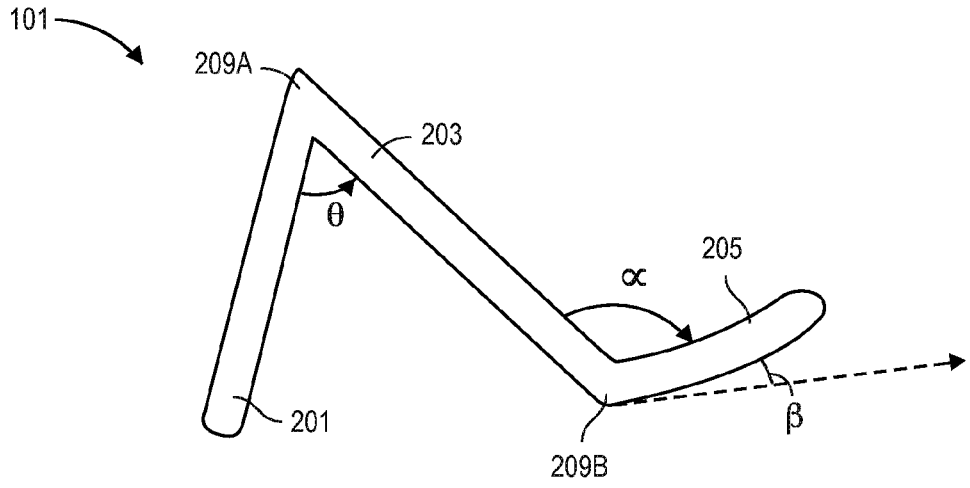
FIG. 3 shows an example peg according to one embodiment.

FIG. 3 shows an example peg 101 according to one embodiment. The example peg 101 shown in FIG. 3 may each include three sections: a base section 201, a middle section 203, and a front section 205. Each of the sections 201, 203, and 205 may be separated by one or more bends 209A and 209B that are defined by the angles θ and α, respectively. Accordingly, the base section 201 is separated from the middle section 203 by the bend 209A defined by the angle θ while the middle section 203 may be separated from front section 205 by the bend 209B defined by the angle α. Each of these sections 201, 203, and 205 and corresponding bends 209A and 209B will be described in further detail below.

The base section 201 may be used for coupling the peg 101 to the frame piece 103 and may be approximately ⅜ to ½ inches in length. In some embodiments, the pegs 101 may be coupled directly to the frame piece 103 using one or more fasteners (e.g., screws and bolts). For example, the base section 201 may be a straight structure that may be directly soldered, welded, or otherwise fastened to a front face 207A of the frame piece 103. In other embodiments, the pegs 101 may be indirectly coupled to the frame piece 103. For example, as shown in FIG. 2, a first set of pegs 101 may be coupled to an intermediate frame 211. In particular, the base section 201 of each peg 101 in the first set of pegs 101 may be coupled to the intermediate frame 211 using one or more fasteners, including bolts, screws, clips, clamps, solder, etc. Thereafter, the intermediate frame 211 may be coupled directly to the frame piece 103 using any type of fasteners, including bolts, screws, clips, clamps, solder, etc. As shown, the intermediate frame 211 is coupled to the frame piece 103 using tabs 213, which are part of the intermediate frame 211, and screws 215. However, as noted above, any type of fasteners may be used. Using the intermediate frame 211 allows multiple pegs 101 to be simultaneously coupled to the frame piece 103 during manufacture or installation. Although the first set of pegs 101 are coupled indirectly to the frame piece 103 via the intermediate frame 211, as noted above in other embodiments, the pegs 101 may be directly coupled to the frame piece 103. For example, as shown in FIG. 2, a second set of pegs 101, which are below the first set of pegs 101, may be coupled directly to the frame piece 103.

As noted above, other techniques may be used for coupling the pegs 101 to the frame piece. For example, as shown in FIG. 1B and described above, the pegs 101 may be coupled to the frame piece 103 using the vertical holes 107, the channels 109, and/or the locking bar 111.

As described above, the base section 201 may be used to couple pegs 101 to the frame piece 103 (either directly or indirectly). In contrast, the middle section 203 may be used to hold a necktie as will be described in greater detail below. In one embodiment, as noted above, the middle section 203 may be separated from the base section 201 by the bend 209A, which has an angle θ. In some embodiments, the middle section 203 is perpendicular to the base section 201. Accordingly, in these embodiments, θ may be equal to 90°. In other embodiments, the middle section 203 may form an upward slope in relation to the base section 201. This upward slope assists in preventing neckties held by the middle section 203 from sliding forward toward the front section 205 and consequently falling off the combined belt and necktie rack 100. In this embodiment, θ may be between 91° and 130° such that an upward slope is created between the base section 201 and the middle section 203. The bend 209A defined by the angle θ may be a sharp bend as shown in FIGS. 1B and 3, which forms a point and an abrupt transition between the base section 201 and the middle section 203. In other embodiments, the bend 209A defined by the angle θ may be a gradual bend, which forms a rounded curve as shown in FIGS. 1A and 2.

Figure 4:
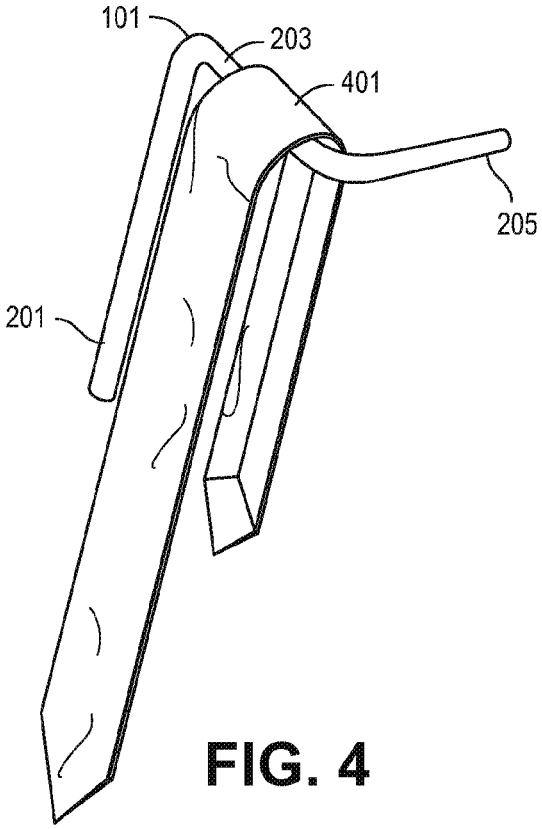
FIG. 4 shows a necktie held on the middle section of a peg according to one embodiment.

FIG. 4 shows a necktie 401 held on the middle section 203. In this embodiment, the necktie 401 is folded in half or nearly in half and draped over middle section 203. By being draped over the middle section 203, the necktie 401 may be sturdily held by the peg 101. In one embodiment, the middle section 203 may have a length to accommodate the dimensions of an average or standard necktie. Since neckties are folded over middle section 203, the width of the average/standard necktie may be measured at the midpoint of neckties. For example, the length of the middle section 203 may be between ⅜ of an inch and 1.5 inches. In particular, the length of the middle section 203 may be 1.25 inches.

Figure 5:
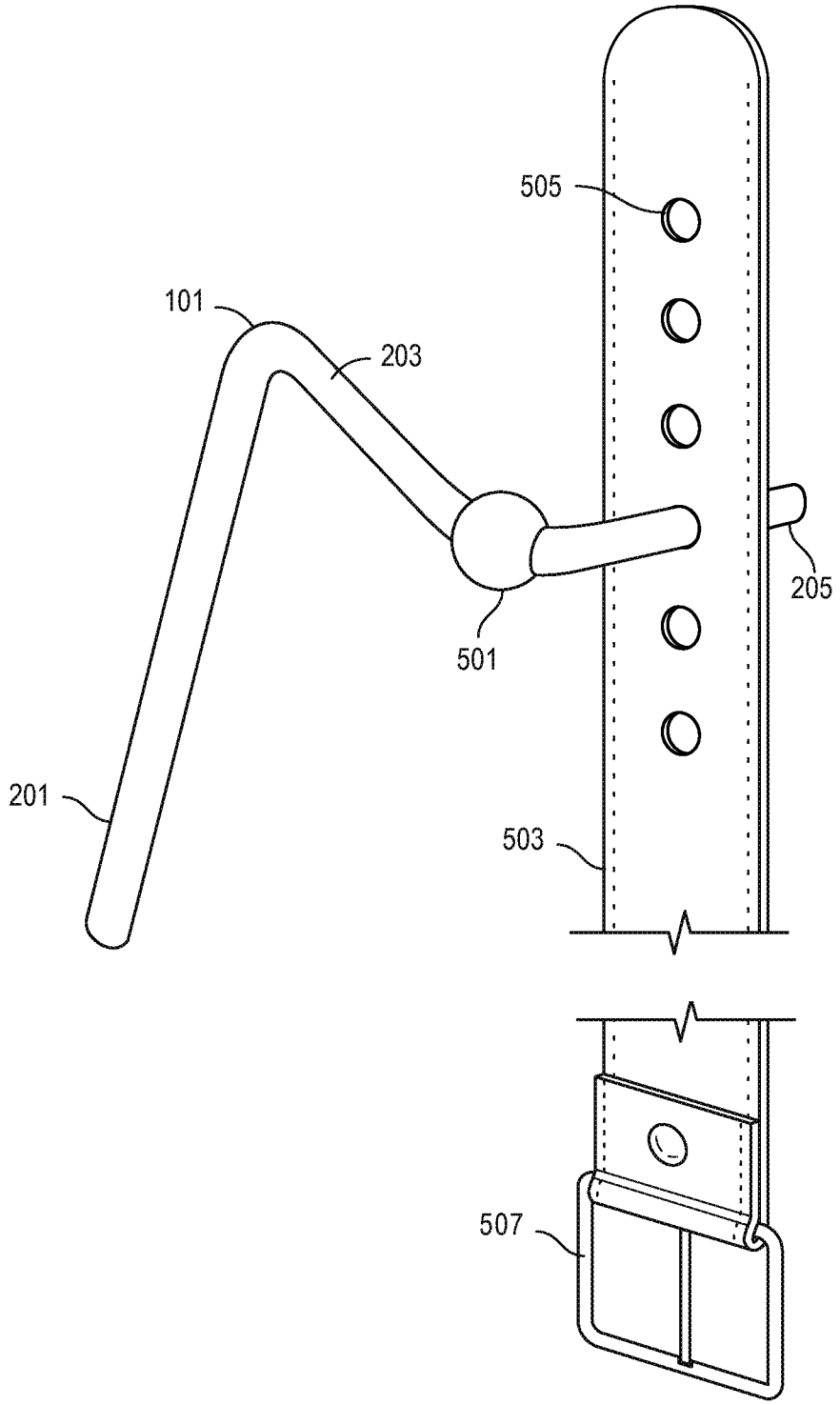
FIG. 5 shows a spherical knob placed at the bend between a front section and a middle section of a peg according to one embodiment.

In one embodiment, the front section 205 may be used to hold a belt as will be described in greater detail below. As noted above, the front section 205 may be separated from the middle section 203 by the bend 209B, which has an angle α. In some embodiments, the front section 205 is perpendicular to the middle section 203. Accordingly, in these embodiments, α may be equal to 90°. In some embodiments, the angle α may be sharp (i.e., forming a distinct point between the middle section 203 and the front section 205) as shown in FIGS. 1B and 3. This sharp angle may inhibit a belt held on the front section 205 from sliding around the bend and onto the middle section 203. As shown in FIG. 5, in some embodiments, a spherical knob 501 may be placed at the bend 209B between the front section 205 and the middle section 203. The spherical knob 501 may have a diameter greater than the diameter or cross-sectional width of the middle section 203 and/or the front section 205. As will be described in greater detail below, the knob 501 may further prevent a hanging belt from sliding onto the middle section 203.

In one embodiment, the cross-sectional size and shape of the base section 201, the middle section 203, and the front section 205 may be identical. For example, each of the sections 201, 203, and 205 may be cylindrical structures (i.e., a circular cross-section) and between 2.0 millimeters and 4.5 millimeters in diameter. In this embodiment, the pegs 101 are sized to fit through the holes in a strap of a standard belt (i.e., a hole punched in the leather strap of a belt and designed to receive a prong of a corresponding buckle). In particular, a user may pass the front section 205 of a peg 101 through a hole 505 of a belt 503 as shown in FIG. 5. In one embodiment, the hole 505 farthest from the buckle 507 of the belt 503 may be chosen to pass through the front section 205 of the peg 101 and the belt 503 may be hung with the buckle 507 of the belt 503 hanging downward in relation to the peg 101. In one embodiment, the belt 503 may remain on the front section 205. In this embodiment, the knob 501 may be located at the bend 209B between the front section 205 and the middle section 203 as shown in FIG. 5 to prevent the belt 503 from sliding onto the middle section 203 where a necktie may be hanging. Accordingly, as noted above, the knob 501 may be sized to be greater in diameter than the hole 505 of the belt 503 (e.g., the diameter of the knob 501 may be greater than 4.5 millimeters). Although described as spherical, in other embodiments, the knob 501 may be any shape, including rectangular and conical.

Figure 6:
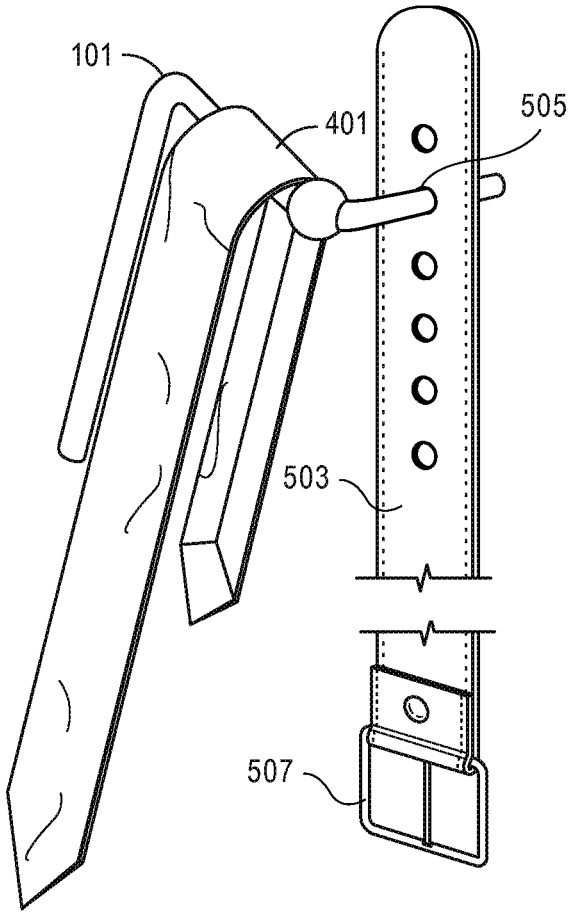
FIG. 6 shows a belt and a tie hanging parallel to each other on a front section and a middle section of a peg, respectively, according to one embodiment.

In embodiments in which the front section 205 forms a 90° angle with the middle section 203, a belt 503 and necktie 401 hanging on a front section 205 and a middle section 203 of a peg 101, respectively, may be parallel to each other as shown in FIG. 6. This parallel arrangement of the belt 503 and the neckties 401 provides a more space efficient system in comparison to a perpendicular belt and necktie arrangement.

Although described as the middle section 203 holding neckties and the front section 205 holding belts, in some embodiments after passing through the front section 205, a belt may be pushed along the continuous peg 101 structure to the middle section 203. In these embodiments, which do not include the knobs 501, the belt may be pushed to rest against the base section 201 and/or the frame piece 103. In particular, although the belt remains on the middle section 203, the belt may be moved to be proximate to the base section 201 and/or the frame piece 103. By moving the belt to rest against the base section 201 and/or the frame piece 103, the belt may maintain some contact and support from the base section 201 and/or the frame piece 103. Further, by moving the belt to rest against the base section 201 and/or the frame piece 103, enough room may remain along the middle section 203 to accommodate a necktie.

Although described above as the cross-sectional size and shape of base section 201, the middle section 203, and the front section 205 being identical, in some embodiments, the sections 201, 203, and 205 may have differently shaped and/or sized cross-sections. For example, as previously described, the middle section 203 and/or the front section 205 may be sized to fit through a hole in a standard sized belt. In contrast, the base section 201 may not need to be sized to be similar to the middle section 203 and the front section 205 since the base section 201 is not designed to fit through a hole in the strap of a belt. In particular, the base section 201 may be a wider and/or flatter structure in comparison to the narrow, cylindrical shape of the middle section 203 and/or the front section 205. This wider and/or flatter structure may assist in providing a larger surface area for coupling the base section 201 to the frame piece 103.

In some embodiments, the front section 205 may be angled or curved upward relative to the highest point of the middle section 203. For example, the front section 205 may form a slope or curve upwards at an angle β relative to a horizontal plane at the highest vertical point of the middle section 203 as shown in FIG. 3. The slope upwards may inhibit a necktie from slipping off the peg 101. In one embodiment, the angle β may be between 5° and 10°. For example, the angle β may be 7°

In one embodiment, the combined belt and necktie rack 100 may be coupled to a wall or another structural element using the one or more mounting blocks 105. In one embodiment, a mounting block 105 may be placed on either end of the frame piece 103 for fixing the combined belt and necktie rack 100 to a structure.

Figure 7:
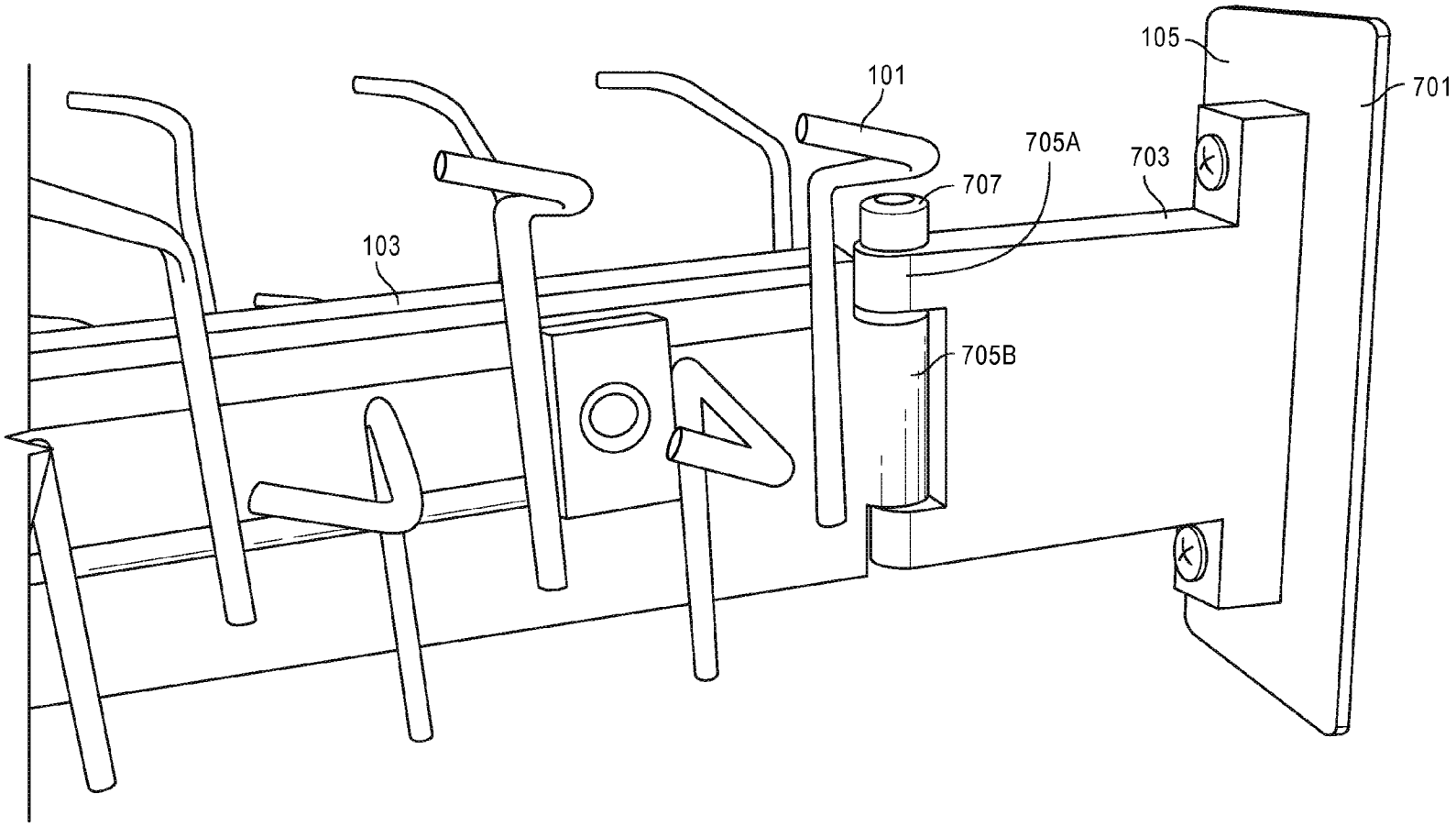
FIG. 7 shows a mounting block including a support plate and a pivot arm according to one embodiment.

In other embodiments, a single mount block 105 may be used for pivotally coupling the combined belt and necktie rack 100 to a wall or structure. For example, a mounting block 105 may include a support plate 701 and a pivot arm 703 as shown in FIG. 7. The support plate 701 may be a flat structure that is used for attaching the combined belt and necktie rack 100 to a wall or another structure. For instance, the support plate 701 may include a set of holes for receiving a corresponding set of bolts or screws, which may be sunk into a wall. In other embodiments, the support plate 701 may be attached to a wall or another structure using other attachment mechanisms (e.g., clips, clamps, adhesives, etc.). The pivot arm 703 may be a structure that couples the mounting block 105 to the frame piece 103 while allowing the frame piece 103 to pivot in relation to the mounting block 105 and/or in relation to a structure on which the combined belt and necktie rack 100 has been installed (e.g., a wall). In one embodiment, the pivot arm 703 and the support plate 701 may be one continuous piece, while in other embodiments the pivot arm 703 and the support plate 701 may be separate pieces. In embodiments in which the pivot arm 703 and the support plate 701 are separate pieces, the support plate 701 and the pivot arm 703 may be coupled together using any coupling mechanism (e.g., screws, bolts, clips, clamps, adhesives, solder, etc.).

In one embodiment, the pivot arm 703 may include a joint element 705A, which works in conjunction with a joint element 705B of the frame piece 103 and a pin 707, for allowing the frame piece 103 to pivot in relation to the mounting block 105. As shown, the joint elements 705A and 705B along with the pin 707 form a barrel hinge; however, in other embodiments, the combined belt and necktie rack 100 may include another type of joint, including a pivot hinge. By providing a pivoting connection, the mounting block 105 (in particular the pivot arm 703) allows the combined belt and necktie rack 100 to be stored away or adjusted for easier access. For example, in one embodiment, the rack 100 may rest against a wall of a closet; however, the rack 100 may be pivoted outwards into an opening of the closet to provide improved access for the user. Upon selecting a belt and/or necktie, the rack 100 may be pivoted back against the wall of the closet. Accordingly, by providing a pivoting connection, the rack 100 may be easily stored away while still allowing for easy access to belts and neckties.

Although described with a pivoting structure, in other embodiments, the mounting blocks 105 may provide a sliding track structure. In these embodiments, the mounting blocks 105 allow the frame piece 103 to be coupled to a wall of a cabinet or closet and slid parallel to the wall to provide access to belts and neckties held on the rack 100. In particular, the frame 103 may be slid into a closet for storage and out of a closet for selection of belts and neckties by a user.

In one embodiment, the combined belt and necktie rack 100 may include multiple rows of pegs 101. For example, as shown in FIG. 1A and FIG. 2, in one embodiment, the rows of pegs 101 may be vertically separated by between 0.75 inches and 1.5 inches. For example, rows of pegs 101 may be separated by 1.0 inches. This measurement may be calculated from identical elements of pegs 101 on each row of pegs 101. FIG. 2 shows multiple rows of pegs 101 on both a front face 207A and a rear face 207B of the frame piece 103. In this embodiment, the belts and neckties on each face 207A and 207B may be accessed by pivoting the frame piece 103 via the mounting block 105 as described above. Further, each row of pegs 101 on each face 207A and 207B may be offset (i.e., each peg 101 on one row may be located between two pegs 101 on a vertically adjacent row). By being offset from each other, each peg 101 may accommodate belts and/or neckties without interfering with belts and neckties hanging on pegs 101 on a vertically adjacent row.

Although each of the pegs 101 on the rack 100 has been described jointly, in some embodiments, each peg 101 may be variably sized and arranged to accommodate for the various types, styles, and sizes of belts and neckties. The decision of the sizes and arrangement of pegs 101 may be made by users or by a manufacturer based on market data.

As described above, a combined belt and necktie rack 100 is described that provides an improved system for hanging and storing belts and neckties. In particular, by hanging belts on pegs 101 through holes in the straps of these belts, the rack 100 may efficiently accommodate a number of belts. Further, by providing elongated pegs 101, the rack 100 may simultaneously hold neckties along with belts in a fashion that allows for efficient storage and easy viewing and removal of belts and neckties. Accordingly, the combined belt and necktie rack 100 described herein provides a more efficient and improved system for hanging and storing belts and neckties by allowing belts and neckties to be hung parallel to each other.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A combined belt and necktie rack, comprising:

a horizontal frame bar;

a mounting block comprising 1) a support plate coupled to a vertical wall or structure, and 2) a pivot arm coupling the support plate to an end of the frame bar, wherein the pivot arm forms a joint with the frame bar that allows the frame bar to pivot relative to the mounting block; and a set of pegs coupled to the frame bar, each of the pegs including 1) a base section for coupling a corresponding peg to the frame bar 2) a front section with a cross-sectional diameter to fit through a hole in a strap of a belt and terminating in an end dimensioned to receive the hole in the strap of the belt, and 3) a middle section, which sits between the base section and the front section, wherein the middle and front section of each of the pegs is substantially parallel to the middle and front section of the other pegs, and wherein the middle section has a length to accommodate a necktie folded over the middle section and wherein the front section is oriented relative to the middle section such that, in use, when the front section is inserted through the hole in the strap of the belt, a plane of the strap of the belt is substantially parallel with a plane of the necktie folded over the middle section.

2. The combined belt and necktie rack of claim 1, wherein the frame bar is a horizontally elongated rectangular structure.

3. The combined belt and necktie rack of claim 1, wherein the set of pegs is arranged in a first row along a front face of the frame bar and a second row along the front face of the frame bar, wherein the first row is above the second row on the front face of the frame bar.

4. The combined belt and necktie rack of claim 3, wherein the first row is separated from the second row by 1.0 inch.

5. The combined belt and necktie rack of claim 3, wherein the set of pegs are further arranged in a third row along a rear face of the frame bar and a fourth row along the rear face of the frame bar, wherein the third row is above the fourth row on the rear face, wherein the rear face is on an opposite side of the frame bar in comparison to the front face.

6. The combined belt and necktie rack of claim 3, wherein the first row is offset from the second row such that each peg in the first row is aligned between two pegs in the second row.

7. The combined belt and necktie rack of claim 1, wherein the middle section is bent at a first angle in relation to the base section, wherein the first angle is between 91° and 130°.

8. The combined belt and necktie rack of claim 1, wherein the front section is bent at a second angle in relation to the middle section, wherein the second angle is 90°.

9. The combined belt and necktie rack of claim 8, wherein the front section is further curved at a third angle in relation to a horizontal plane at the highest point of the middle section, wherein the third angle is between 5° and 10°.

10. The combined belt and necktie rack of claim 1, wherein one or more of the pegs in the set of pegs includes a knob located between the middle section and the front section, wherein the cross-sectional diameter of the knob is greater than the cross-sectional diameter of the front section.

11. The combined belt and necktie rack of claim 1 further comprising one of (1) wherein the cross-sectional diameter of the middle section and the front section for each of the pegs in the set of pegs is between 2.0 millimeters and 4.5 millimeters, (2) wherein a length of the middle section is between ⅜ of an inch and 1.5 inches, (3) wherein a length of the front section is between ⅜ of an inch and 1.5 inches, or (4) wherein each peg in the set of pegs is 1.25 inches apart from each adjacent peg in the set of pegs.

12. The combined belt and necktie rack of claim 1, further comprising:

a set of channels on a top side of the frame bar and each of the channels is sized to accommodate a cross-section of one of the pegs;

a sets of vertical holes within the frame bar, wherein each of the vertical holes is located at the center of one of the channels and each of the holes is sized to accommodate the base section such that each of the pegs are firmly held within the channels to be static relative to the frame bar; and a locking bar coupled to the frame bar to cover the channels and lock the pegs within the channels.

13. The combined belt and necktie rack of claim 1, wherein the middle section extends away from the frame bar, and the wherein the front section is bent sideways relative to the to the middle section such that when the front section is inserted through the hole in the strap of the belt, the flat surface of the strap of the belt is substantially parallel with the plane of the necktie folded over the middle section.

14. The combined belt and necktie rack of claim 1, wherein the middle and front section of each of the pegs has substantially the same length as the middle and front section of the other pegs.

15. The combined belt and necktie rack of claim 1, wherein the set of pegs is arranged in a first horizontal row along a front face of the frame bar.

16. A combined belt and necktie rack, comprising:

a horizontally disposed frame bar;

a mounting block comprising 1) a support plate coupled to a vertical wall or structure, and 2) a pivot arm coupling the support plate to an end of the frame bar, wherein the pivot arm forms a joint with the frame bar that allows the frame bar to pivot relative to the mounting block; and a set of at least three pegs coupled to the frame bar, each of the pegs including 1) a base section for coupling a corresponding peg to the frame bar 2) a front section with a cross-sectional diameter to fit through a hole in a strap of a belt and terminating in an end dimensioned to receive the hole in the strap of the belt, and 3) a middle section, which sits between the base section and the front section, wherein the middle and front section of each of the pegs is substantially parallel to the middle and front section of the other pegs, wherein the middle section has a length to accommodate a necktie folded over the middle section and wherein the front section is bent at a sharp 90 degree angle relative to the middle section.

17. The combined belt and necktie rack of claim 16, wherein the middle section extends away from the frame bar, and the wherein the front section is bent sideways relative to the to the middle section such that when the front section is inserted through a hole in the strap of the belt, a flat surface of the strap of the belt is substantially parallel with a fold of the necktie folded over the middle section.

18. The combined belt and necktie rack of claim 16, wherein the belt comprises a buckle, wherein the hole in the strap of the belt is a hole punched in the strap and designed to receive a prong of the buckle.

19. The combined belt and necktie rack of claim 16, wherein the middle and front section of each of the pegs has substantially the same length as the middle and front section of the other pegs.

20. The combined belt and necktie rack of claim 16, wherein the set of pegs is arranged in a first horizontal row along a front face of the frame bar.

21. A combined belt and necktie rack, comprising:

a frame bar that is a horizontal, elongated bar;

a mounting block comprising 1) a support plate coupled to a vertical wall or structure, and 2) a pivot arm coupling the support plate to an end of the frame bar, wherein the pivot arm forms a joint with the frame bar that allows the frame bar to pivot relative to the mounting block; and a plurality of pegs coupled to the frame bar, each of the pegs including 1) a base section for coupling each of the pegs to the frame bar 2) a front section with a cross-sectional shape and terminating end to fit through a hole in a strap of a belt, and 3) a middle section, which attaches the base section to the front section, wherein the middle section has a length to accommodate a necktie folded over the middle section, and wherein the front section is bent relative to the middle section such that when the hole in the strap of the belt is slid over the front section, flat surfaces of the strap of the belt are substantially parallel with flat surfaces of the necktie folded over the middle section.

22. The combined belt and necktie rack of claim 21, wherein the middle section extends away from the frame bar, and the wherein the front section is bent sideways relative to the to the middle section such that when the front section is inserted through the hole in the strap of the belt, a flat surface of the strap of the belt is substantially parallel with a fold of the necktie folded over the middle section.

23. The combined belt and necktie rack of claim 21, wherein the belt comprises a buckle, wherein the hole in the strap of the belt is a hole punched in the strap and designed to receive a prong of the buckle.

24. The combined belt and necktie rack of claim 21, wherein the middle and front section of each of the pegs has substantially the same length as the middle and front section of the other pegs.

25. The combined belt and necktie rack of claim 21, wherein the set of pegs is arranged in a first horizontal row along a front face of the frame bar.

* * * * *